US011081296B2

(12) United States Patent
Tian et al.

(10) Patent No.: US 11,081,296 B2
(45) Date of Patent: Aug. 3, 2021

(54) STATIONARY CONTACT ASSEMBLY AND CORRESPONDING SWITCH CONTACT

(71) Applicant: SCHNEIDER ELECTRIC INDUSTRIES SAS, Rueil Malmaison (FR)

(72) Inventors: Haifeng Tian, Shanghai (CN); Patrick Larcher, Eybens (FR)

(73) Assignee: SCHNEIDER ELECTRIC INDUSTRIES SAS, Rueil Malmaison (FR)

( * ) Notice: Subject to any disclaimer, the term of this patent is extended or adjusted under 35 U.S.C. 154(b) by 0 days.

(21) Appl. No.: 16/387,796

(22) Filed: Apr. 18, 2019

(65) Prior Publication Data

US 2019/0333721 A1 Oct. 31, 2019

(30) Foreign Application Priority Data

Apr. 19, 2018 (CN) ..... 201820563270.7

(51) Int. Cl.
*H01H 9/34* (2006.01)
*H01H 9/44* (2006.01)

(52) U.S. Cl.
CPC ..... *H01H 9/34* (2013.01); *H01H 9/446* (2013.01)

(58) Field of Classification Search
CPC ..... H01H 9/34; H01H 9/446; H01H 9/46
See application file for complete search history.

(56) References Cited

U.S. PATENT DOCUMENTS 4,077,024 A * 2/1978 Lisnay ..... H01H 71/1009 335/10
4,654,491 A * 3/1987 Maier ..... H01H 9/46 218/33

(Continued)

FOREIGN PATENT DOCUMENTS

DE 4018674 A1 4/1991
EP 0207458 A2 1/1987

(Continued)

OTHER PUBLICATIONS

Extended European Search Report dated Sep. 13, 2019 for EP Application No. 19305505.0-1204, 9 pages.

*Primary Examiner* — Truc T Nguyen
(74) *Attorney, Agent, or Firm* — Locke Lord LLP

(57) ABSTRACT

Embodiments of the present disclosure provide a stationary contact assembly and a corresponding switch contact. The stationary contact assembly comprises: a stationary contact body (21); a stationary contact point (23) placed on the stationary contact body (21); and an arc-guiding member (25) fixed on the stationary contact body (21) and including an arc guiding portion (251), the arc guiding portion (251) comprising a first end (A) and a second end (B) that are opposite to each other, the first end (A) being close to the stationary contact point (23), a direction form the first end (A) to the second end (B) defining a main movement direction (F) of arc. The arc guiding portion (251) of the arc-guiding member (25) comprises an arc-guiding section (2511) at the first end (A), the arc-guiding section is adapted to guide the arc away from the stationary contact point (23) into the arc guiding portion (251), and the stationary contact point (23) is close to or in contact with the arc-guiding section (2511) in the main movement direction (F) of the arc. The stationary contact assembly of the embodiments of the present disclosure has an improved arc-guiding member that (Continued)

can guide the arc to quickly leave the contact point, enhance the mechanical strength of the stationary contact and reduce the production cost of the contact.

15 Claims, 6 Drawing Sheets

(56) References Cited

U.S. PATENT DOCUMENTS

| | | | | |
|---|---|---|---|---|
| 4,689,588 | A * | 8/1987 | Murata | H01H 9/46 218/147 |
| 5,075,520 | A | 12/1991 | Mueller et al. | |
| 5,097,104 | A * | 3/1992 | Weichert | H01H 9/46 218/146 |
| 5,969,314 | A * | 10/1999 | Rakus | H01H 9/46 218/14 |
| 6,300,586 | B1 | 10/2001 | Doughty et al. | |
| 2006/0006145 | A1* | 1/2006 | Baiatu | H01H 9/42 218/153 |
| 2008/0074216 | A1* | 3/2008 | Annis | H01H 9/446 335/201 |
| 2009/0283500 | A1* | 11/2009 | Yanase | H01H 9/302 218/1 |
| 2010/0288732 | A1* | 11/2010 | Heins | H01H 9/46 218/22 |
| 2010/0301015 | A1* | 12/2010 | Becker | H01H 9/46 218/151 |
| 2014/0103013 | A1* | 4/2014 | Chen | H01H 77/02 218/147 |
| 2014/0131317 | A1* | 5/2014 | Malingowski | H01H 73/18 218/148 |
| 2014/0202990 | A1* | 7/2014 | Puhalla | H01H 33/20 218/148 |
| 2018/0061591 | A1* | 3/2018 | Nan | H01H 50/54 |

FOREIGN PATENT DOCUMENTS

| | | | |
|---|---|---|---|
| EP | 0400442 | A2 | 12/1990 |
| FR | 2959347 | A1 | 10/2011 |

* cited by examiner

STATIONARY CONTACT ASSEMBLY AND CORRESPONDING SWITCH CONTACT

The present application claims priority under 35 U.S.C. § 119 to Chinese Patent Application No. 201820563270.7, filed on Apr. 19, 2018, the entire contents of which are hereby incorporated by reference.

FIELD

The present disclosure relates to contacts for a power switchgear, and more specifically to a stationary contact assembly which is used for a power switchgear and includes an arc-guiding member, and corresponding switch contacts.

BACKGROUND

When a power switchgear such as a contactor or a circuit breaker is being disconnected, an arc is generated between the separated movable contact and stationary contact. The switchgear does not actually complete the breaking operation until the generated arc is extinguished. Traditionally, the means of extinguishing the arc is to drive the arc away from the contacts by means of an electromagnetic force, so as to gradually extinguish the arc. An arc extinguishing device and an arc-guiding member are usually provided around the contacts. In particular, the arc-guiding member may be disposed between the contacts and the arc extinguishing device such that the arc generated when the switchgear is being disconnected exits the contact along the arc-guiding member, and the arc eventually enters the arc extinguishing device to be extinguished.

The contact points on the movable and stationary contacts are usually made of an ablation-resistant alloy material, such as copper or silver alloy. However, if the arc-guiding member is improperly disposed, the arc may stay on the stationary contact for a long time, which still causes severe ablation of the contact point, thereby reducing the service life of the contact point.

In addition, since the arc-guiding member and the stationary contact are mechanically connected in a connection manner such as screw affixation, if the mechanical connection between the arc-guiding member and the stationary contact is unreasonable, the contact will deform during use, causing deterioration of contact performance. At the same time, since the contact point is disposed on the contact, the deformation of the contact also causes the position of the contact point to move, which further affects the speed at which the arc leaves the contact point so that arc duration and time for extinguishing the arc become longer, thereby reducing the breaking efficiency and use performance of the switchgear, and even causing the switchgear unable to be further used.

SUMMARY

In order to guide the arc to quickly leave the contact points, enhance the mechanical strength of the stationary contact and reduce the production cost of the contact, embodiments of the present disclosure provide a stationary contact assembly that includes an improved arc-guiding member and can be used for power switchgear.

According to an aspect of the present disclosure, a stationary contact assembly is provided. The stationary contact assembly comprises: a stationary contact body; a stationary contact point placed on the stationary contact body; and an arc-guiding member fixed on the stationary contact body and comprising an arc guiding portion, the arc guiding portion comprising a first end and a second end opposite to each other, the first end being close to the stationary contact point, a direction form the first end to the second end defining a main movement direction of arc; the arc guiding portion of the arc-guiding member comprising an arc-guiding section at the first end, the arc-guiding section being adapted to guide the arc away from the stationary contact point into the arc guiding portion, and the stationary contact point being close to or in contact with the arc-guiding section in the main movement direction of the arc.

With the arc-guiding section being provided and the stationary contact being disposed close to or in contact with the arc-guiding section in the main movement direction of the arc, the arc can quickly leave the contact point into the arc-guiding member in the main movement direction of the arc, which accelerates the speed at which the arc leaves the contact point, reduces the ablation of the stationary contact point by the arc and extends the service life of the contact.

In some embodiments of the present disclosure, the arc-guiding member is fixed onto the stationary contact body by welding. In this way, the structure of the arc-guiding member is simplified, the manufacture and installation are simplified accordingly, and the cost of the switch contact and the arc-guiding member is reduced.

In some embodiments of the present disclosure, the arc-guiding member is formed with holding sheets at the first end of the arc guiding portion, and the arc-guiding member is snap-fitted and fixed onto the stationary contact body by bending the holding sheets. In this embodiment, the arc-guiding member comprises a larger arc-guiding section along the main movement direction of the arc, which facilitates movement of the arc away from the stationary contact point. In addition, this also simplifies the construction of the arc-guiding member and correspondingly simplifies manufacturing and installation, and reduces the production costs of the switch contacts and the arc-guiding member.

In some embodiments of the present disclosure, the arc-guiding member further comprises a mounting portion adapted to fix the arc-guiding member onto the stationary contact body; the mounting portion is connected to the arc guiding portion, an opening is formed at the connection of the mounting portion and the arc guiding portion, the opening is adapted to allow the stationary contact body to pass therethrough so that the stationary contact point is close to the arc-guiding section at the opening. With the mounting portion being provided, the arc-guiding member can be more stably fixed on the stationary contact body, and the mechanical connection between the arc-guiding member and the stationary contact body can be enhanced.

In some embodiments of the present disclosure, the mounting portion is formed with a support platform on a side adjacent to the opening, and the support platform supports the stationary contact body at the opening. Through the support platform, the stationary contact body can be effectively supported to prevent deformation of the stationary contact, while the support length of the stationary contact body and the arc-guiding member is also reduced, thereby reducing the production cost.

In some embodiments of the present disclosure, the mounting portion is made of a magnetically conductive material at least at a section forming the support platform. The section forming the support platform is advantageous for enhancing the electromagnetic force that drives the arc to move, which further accelerates the speed at which the arc leaves the stationary contact point.

In some embodiments of the present disclosure, an side of the stationary contact body passing through the opening is located below the arc-guiding section so as to be clamped between the arc-guiding section and the support platform. By clamping the suspended end of the stationary contact body between the arc-guiding section and the support platform, deformation that may occur in the ablation process is further suppressed.

In some embodiments of the present disclosure, the mounting portion is formed with a mounting hole for fixing the arc-guiding member onto the stationary contact body via a screw. By means of the mounting hole, the arc-guiding member can be fixed to the stationary contact body by means of the screw.

In some embodiments of the present disclosure, the mounting hole of the mounting portion is a circular hole or U-shaped hole. Forming the mounting hole as a U-shaped hole more facilitates the movement of the screw element into the mounting hole.

In some embodiments of the present disclosure, the arc-guiding section is a protrusion extending from the arc guiding portion, and the protrusion extends in a direction opposite to the main movement direction of the arc. It is possible to, by forming the protrusion, make the arc-guiding section as close as possible to the stationary contact point with respect to other sections of the arc-guiding member, which is more advantageous for the arc to quickly enter the arc-guiding section.

In some embodiments of the present disclosure, the protrusion is tongue-shaped. The tongue-shaped protrusion makes the arc-guiding section more adapted for the shape of the stationary contact point, and better facilitates the arc-guiding section close to the stationary contact point.

In some embodiments of the present disclosure, a region of the arc guiding portion following the arc-guiding section along the main movement direction of the arc is of a larger thickness than other regions of the arc guiding portion. The region of the arc guiding portion following the arc-guiding section is prone to loss due to ablation of the arc, and these regions prone to ablation loss may be thickened to further improve the service life of the arc-guiding member.

In certain embodiments of the present disclosure, the arc guiding portion is integrally formed. By integrally forming the arc guiding portion, the arc guiding portion can be formed as a continuous whole, which facilitates the movement of the arc on the arc-guiding member.

In certain embodiments of the present disclosure, the arc-guiding member is integrally formed. Forming the arc-guiding member integrally is more advantageous for enhancing the mechanical strength of the arc-guiding member, and is also beneficial for enhancing the support for the stationary contact body.

In some embodiments of the present disclosure, the arc-guiding member is formed in a zigzag shape. The zigzag arc-guiding member facilitates a fixed connection with the stationary contact body.

In some embodiments of the present disclosure, the stationary contact body is of a U shape with a long side and a short side, the stationary contact point is placed on the short side of the U shape, and the short side of the stationary contact body passes through the opening of the arc-guiding member. In this way, the material cost of the stationary contact is reduced, and the short side of the stationary contact body is effectively supported by the support platform to avoid deformation.

In another aspect of the present disclosure, there is provided a switch contact. The switch contact comprises a stationary contact, a movable contact, and an arc extinguishing element, the stationary contact comprising the stationary contact assembly as described above.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE DRAWINGS

Through the following detailed description with reference to the accompanying drawings, the above and other features, advantages and aspects of various embodiments of the present disclosure will become more apparent. Throughout the drawings, the same reference symbols generally refer to the same elements, wherein.

DETAILED DESCRIPTION OF EMBODIMENTS

Figure 1:
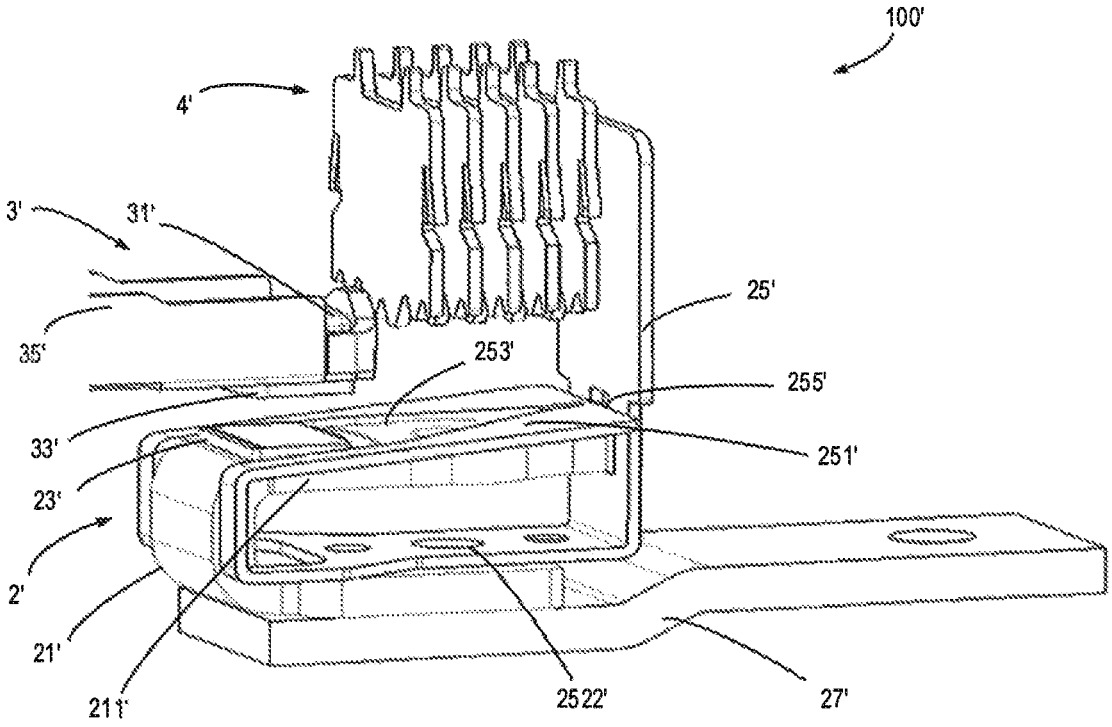
FIG. 1 shows a perspective view of a conventional switch contact structure.

Preferred embodiments of the present disclosure will be described as follows in greater detail with reference to the drawings. Although preferred embodiments of the present disclosure are illustrated in the drawings, it is to be understood that the present disclosure described herein can be implemented in various manners, not limited to the embodiments illustrated herein. Rather, these embodiments are provided to make the present disclosure described herein clearer and more complete and convey the scope of the present disclosure described herein completely to those skilled in the art. Those skilled in the art may obtain alternative technical solutions from the following description without departing from the spirit and scope of the disclosure.

As used herein, the term "includes" and its variants are to be read as open-ended terms that mean "includes, but is not limited to." The term "or" is to be read as "and/or" unless the context clearly indicates otherwise. The term "based on" is to be read as "based at least in part on." The term "one example embodiment" and "an example embodiment" are to be read as "at least one example embodiment." The term "another embodiment" is to be read as "at least one other embodiment." Terms "a first", "a second" and others can denote different or identical objects. The following text may also contain other explicit or implicit definitions.

FIG. 1 shows a switch contact 100' of a conventional contactor, comprising a stationary contact 2', a movable contact 3' and an arc extinguishing element 4'. The movable contact 3' includes a movable contact body 31', a movable contact point 33' and a movable contact holder 35', and the stationary contact 2' includes a stationary contact body 21', a stationary contact point 23', an arc-guiding member 25' and a stationary contact extension 27'. As shown in FIG. 1, the movable contact point 33' is disposed opposite to the stationary contact point 23'. When the contactor is closed, the movable contact point 33' and the stationary contact point 23' are in contact with each other, and when the contactor is open, the movable contact point 33' is separated from the stationary contact point 23'. The stationary contact point 23' is placed on the stationary contact body 21' as shown in FIG. 1, and the stationary contact body 21' is disposed on the stationary contact extension 27', and then the d-shaped arc-guiding member 25' is fixed on the stationary contact body 21'.

The stationary contact point 23' is located in a V-shaped opening 253' of the arc-guiding member 25'. The arc generated when the contactor is being disconnected enters the arc-guiding member 25' from both sides of the stationary contact point, then turns to move in a direction toward the arc extinguishing element 4', and finally is extinguished by the arc extinguishing element 4'. It can be seen that the arc leaving the contact first moves toward the two sides of the V-shaped opening 253', and then needs to make a turn so as to move in the direction toward the arc extinguishing element 4'. Such a turn delays the movement of the arc. In addition, since an arc-guiding segment 251' of the arc-guiding member 25' is snap-fitted with its vertical segment on the right side of the d-shape, this also affects the speed at which the arc moves therethrough.

Further, a snap-fitting hole 255' is formed in the vertical portion on the right side of the d-shape of the arc-guiding member 25', and one end of the U-shape of the stationary contact body 21' is inserted into the snap-fitting hole 255'. As shown in FIG. 1, one side of the U-shape of the stationary contact body 21' is placed on the stationary contact extension 27', but a portion of the other side of the U-shape of the stationary contact body 21', except for the end supported in the snap-fitting hole 255', is not supported and is in a suspended state. Such a structure is prone to cause the stationary contact body of the suspended portion to be deformed during the ablation of the arc.

Embodiments of the present disclosure generally relate to a stationary contact assembly and, in particular, a stationary contact assembly that is used for a power switchgear and includes an arc-guiding member. However, it should be understood that the present disclosure is not limited to a stationary contact assembly that is only used in a power switchgear, and that the contacts in the apparatus that require current breaking and closing as defined by the spirit and scope of the appended claims should be considered to be within the scope of protection of the present disclosure.

In the conventional switch contacts, although the structure of the arc-guiding member may guide the arc away from the contact, the movement speed of the arc is affected due to its inherent structure. In addition, the structure of such an arc-guiding member is also liable to result in deformation of the stationary contact during ablation of the arc.

The present disclosure proposes a stationary contact assembly that includes an improved arc-guiding member, and corresponding switch contacts. The stationary contact assembly of the present disclosure improves the movement path of the arc when the switch contacts are separated by improving the structure of the arc-guiding member, and the arc may leave the contact at a faster moving speed, which increases the service life of the contacts and also reduces the time of arc burning. In addition, the stationary contact assembly of the present disclosure also improves the mounting structure between the arc-guiding member and the stationary contact body. Such an improvement suppresses deformation of the contact and improves the reliability of the switchgear.

Figure 2:
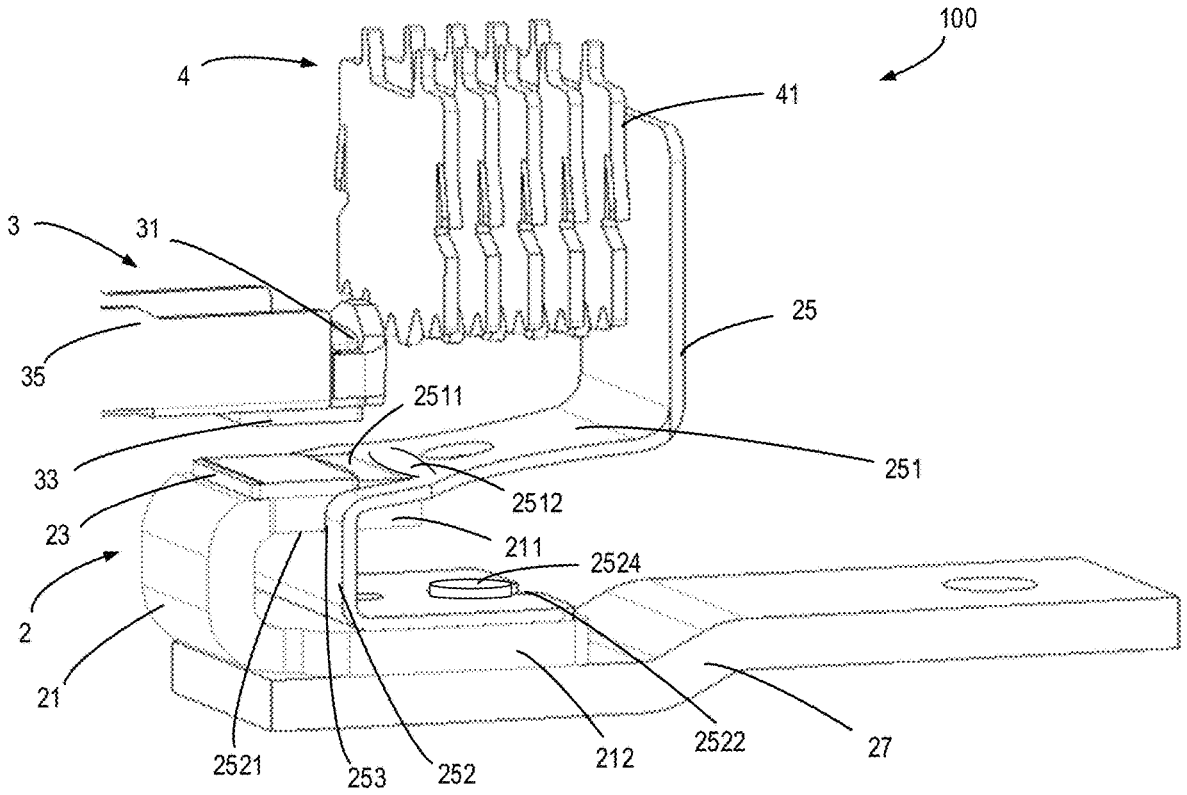
FIG. 2 shows a perspective view of a switch contact structure according to an embodiment of the present disclosure.

FIG. 2 shows a perspective view of a switch contact structure in accordance with an embodiment of the present disclosure. As shown, the switch contact 100 may include a stationary contact 2, a movable contact 3, and an arc extinguishing element 4 comprised of a plurality of arc extinguishing plates 41. The stationary contact 2 and the movable contact 3 are oppositely disposed for the opening and closing of the switch, and the arc extinguishing plates 41 are disposed at the end of the arc-guiding member 25 of the stationary contact 2 to extinguish the arc. As shown in the figure, there are five arc extinguishing plates, but other numbers of arc extinguishing plates, such as 4, 6 or 7 plates, may also be set according to the voltage and current level of the switchgear and the specific structure of the switch contacts. The movable contact 3 may include a movable contact body 31, a movable contact point 33 and a movable contact holder 35. The movable contact point 33 is disposed on the movable contact body 31, and the movable contact body 31 is fixed to the movable contact holder 35.

As shown in FIG. 2, the stationary contact 2 may include a stationary contact body 21, a stationary contact point 23, an arc-guiding member 25, and a stationary contact extension 27, wherein the stationary contact body 21 may be mounted on the stationary contact extension 27, the stationary contact point 23 is disposed on the stationary contact body 21, and the arc-guiding member 25 is fixed to the stationary contact body 21.

Figure 3:
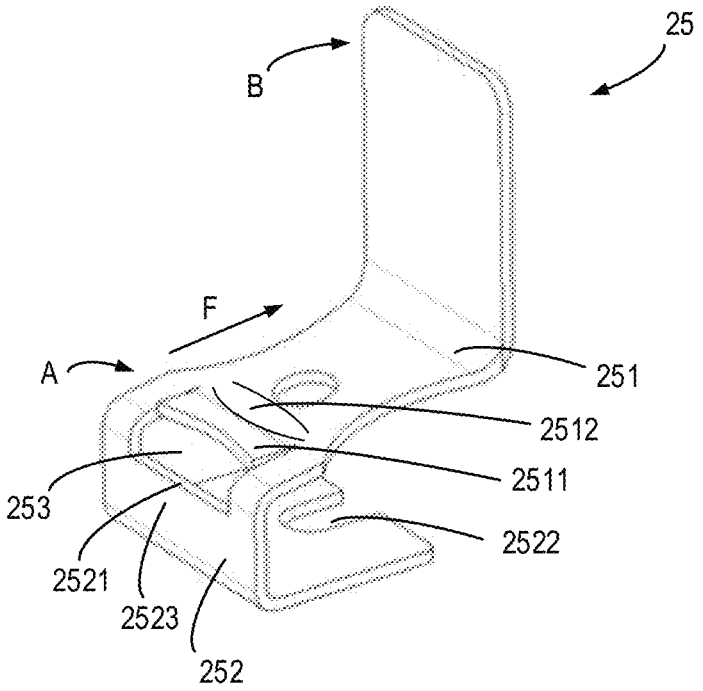
FIG. 3 shows a perspective view of an arc-guiding member according to an embodiment of the present disclosure.

As shown in FIG. 2 and FIG. 3, the arc-guiding member 25 may be divided into an arc guiding portion 251 and a mounting portion 252, wherein the arc guiding portion 251 is used to guide the arc to move from the stationary contact point 23 to the arc extinguishing plates 41, and the mounting portion 252 is used to fix the arc-guiding member 25 to the stationary contact body 21 and support the stationary contact body 21. Wherein, the mounting portion 252 is connected with the arc guiding portion 251, and an opening 253 may be formed at the connection of the mounting portion 252 and the arc guiding portion 251, and the stationary contact body 21 passes through the opening 253 such that the stationary contact point 23 is located in the opening 253 and close to the arc guiding portion 251.

As shown in FIG. 2 and FIG. 3, the arc-guiding member 25 has a zigzag shape. The arc guiding portion 251 and the mounting portion 252 of the arc-guiding member 25 may both be the L-shape as shown in the figure, and a lower end portion of the arc guiding portion 251 may be connected with an upper end portion of the mounting portion 252 to form the arc-guiding member 25 in the zigzag shape.

As shown in FIG. 3, the arc guiding portion 251 has a first end A and a second end B, and a direction from the first end A to the second end B is defined as a direction F. The direction F is actually a main movement direction of the arc on the arc-guiding member 25 toward the arc extinguishing plates 41. The main movement direction of the arc refers to an overall arc movement direction, other than other local movement directions which are caused due to impact of an electromagnetic force or other factors and are different from the direction F. The arc guiding portion 251 has an arc-guiding section 2511 formed at the first end A. In FIG. 3, the arc-guiding section 2511 may be a tongue extending from the arc guiding portion 251 toward the opening 253, and the tongue extends in a direction opposite to the main movement direction F of the arc. The tongue-shaped arc-guiding section 2511 directly faces the stationary contact point 23 in the opening 253 and is as close as possible to the stationary contact point 23 so that the arc may directly leave the stationary contact point 23 in the main movement direction F of the arc through the arc-guiding section 2511 and enter the arc guiding portion 251. More specifically, the arc-guiding section 2511 may be close to or in contact with the stationary contact point 23. Alternatively, the arc-guiding section 2511 may also be formed as a protrusion of any shape extending from the arc guiding portion 251 toward the opening 253, the protrusion directly faces the stationary contact point 23 in the opening 253 and gets close to the stationary contact point 23 as much as possible, so that the arc may directly leave the stationary contact point 23 in the main movement direction F of the arc through the protrusion and enter the arc guiding portion 251.

With the arc-guiding section 2511 being provided in the arc-guiding member 25, the arc directly enters from the stationary contact point 21 into the arc guiding portion 251 in the main movement direction F of the arc, thereby enabling the arc to be quickly guided away from the stationary contact point, reducing the arc ablation time of the stationary contact point, prolonging the service life of the stationary contact point and also reducing the total time required to extinguish the arc, and significantly improving the arc extinguishing efficiency.

As shown in FIG. 3, the arc-guiding member 25 also has a mounting portion 252 and an opening 253. The opening 253 may be located at a turn-over connection of the mounting portion 252 and the arc guiding portion 251, the opening 253 is configured to allow the stationary contact body 21 to pass therethrough, and the stationary contact point 23 is located in the opening 253 and adjacent to the arc-guiding section 2511 of the arc guiding portion 251. The opening 253 is generally rectangular as shown in the figures, but alternatively, the opening 253 may also be in other shapes that allow the stationary contact body 21 to pass therethrough. The mounting portion 252 is formed with a support platform 2521 on a side adjacent to the opening 253, and the support platform 2521 supports the stationary contact body 21 at the opening 253 (see FIG. 2).

Specifically, as shown in FIG. 2, the stationary contact body 21 is formed in a U shape whose one side 212 is long and the other side 211 is short. The mounting portion 252 of the arc-guiding member 25 is mounted on the long side 212 of the U shape, the stationary contact point 23 is placed on the short side 211 of the U shape, and the short side 211 of the stationary contact body 21 passes through the opening of the arc-guiding member and is supported by the support platform 2521. At the same time, the one side 211 of the stationary contact body 21 passing through the opening 253 is located below the arc-guiding section 2511 such that the stationary contact body at this side 211 is clamped between the arc-guiding section 2511 and the support platform 2521.

With the support platform 2521 being provided, the suspended portion of the conventional stationary contact body 21' is supported, and the snap-fitting hole 255' in FIG. 1 is no longer needed, which reduces the length of the stationary contact body, and further simplifies the structure of the arc-guiding member relative to the structure of the conventional arc-guiding member. The simplification of this structure reduces the material used to manufacture the stationary contact body and the arc-guiding member, and reduces the cost. Furthermore, the reduced material of the arc-guiding member may be added to other portions of the arc-guiding member, such as the arc guiding portion 251 of the arc-guiding member 25, particularly a region 2512 of the arc guiding portion 251 following the arc-guiding section 2511 in the main movement direction F of the arc. These regions are prone to loss due to ablation of the arc, and the saved material may be used to thicken these regions prone to loss due to ablation of the arc so as to further increase the service life of the arc-guiding member.

Moreover, since the stationary contact body 21 is supported at the support platform 2521 of the mounting portion 252, and the length of the stationary contact body on the suspended side is shortened, the possibility that the stationary contact body deforms during the arc ablation is greatly reduced. Therefore, the displacement of the stationary contact point caused by the deformation of the stationary contact body is correspondingly reduced, thereby reducing a series of the performance deterioration of the contacts caused by the displacement of the stationary contact point. One side 211 of the stationary contact body 21 is clamped between the arc-guiding section 2511 and the support platform 2521, and this clamping further suppresses deformation of the contact due to ablation.

Furthermore, the support platform 2521 for supporting the stationary contact body may have a positive influence on the electromagnetic force that drives the arc to move. The electromagnetic force that drives the arc to move originates from the magnetic field force induced by the current in the stationary contact body. Meanwhile, referring to FIGS. 1 and 2, as compared with the U-shaped stationary contact body 21' in FIG. 1, a section 2523 (which is meanwhile also part of the mounting portion 252 of the arc-guiding member 25) for forming the support platform 2521 is added on the inner side of the U-shaped stationary contact body 21 in FIG. 2, and the section 2523 as part of the arc-guiding member 25 may be generally made of an electrically conductive material or magnetically conductive material. Preferably, the section 2523 is made of a magnetically conductive material. This is equivalent to adding a "core" portion on the inner side of the U-shaped stationary contact body 21, thereby further enhancing the magnetic field force induced by the current in the stationary contact body. The speed at which the arc moves away from the stationary contact point is accelerated due to the enhanced electromagnetic force that drives the arc to move.

As shown in FIGS. 2 and 3, a bottom portion of the mounting portion 252 of the arc-guiding member further includes a mounting hole 2522 for fixing the arc-guiding member 25 to the stationary contact body 21 by providing a screw 2524 in the mounting hole 2522. The mounting hole 2522 may be a circular hole or a U-shaped hole. Preferably, the mounting hole 2522 is a U-shaped hole, which more facilitates the movement of the screw into the mounting hole.

The arc-guiding member shown in FIGS. 2 and 3 may be integrally formed, or formed by assembling the arc guiding portion and mounting portion which are manufactured separately. Wherein, the arc guiding portion of the arc-guiding member may be integrally formed, or formed in a non-integral manner, in which the arc guiding portion is formed as a continuous whole by a suitable process. Compared with the manner in which the arc-guiding segment 251' of the arc-guiding member 25' of FIG. 1 is snap-fitted with its vertical segment on the right side of the d-shape, the embodiment of the present disclosure greatly facilitates the movement of the arc on the arc-guiding member.

Figure 4A:
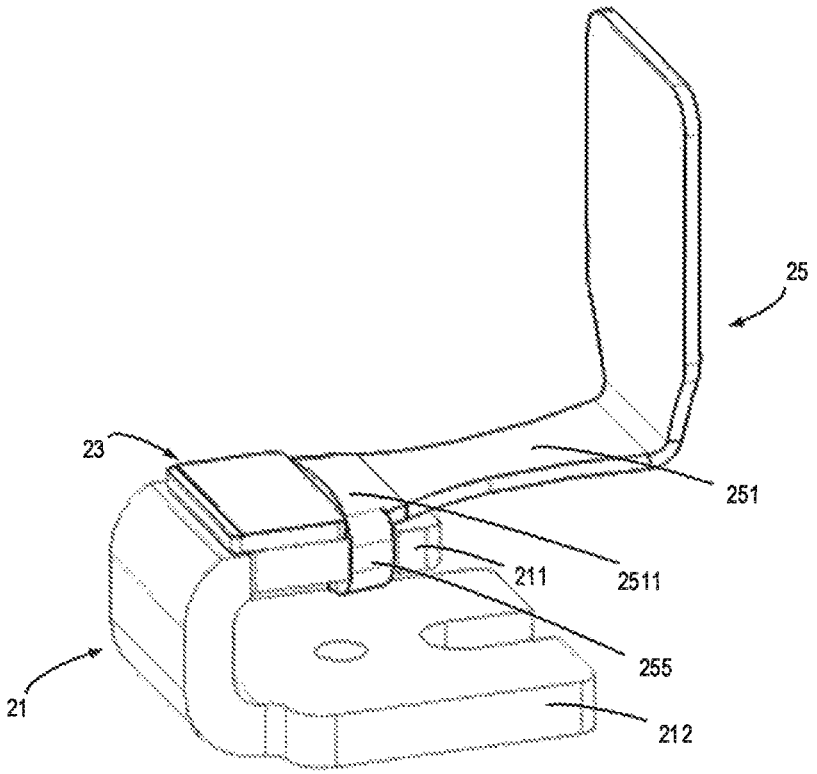
FIG. 4*a* shows a perspective view after a stationary contact body is fixedly connected with an arc-guiding member according to another embodiment of the present disclosure.
Figure 4B:
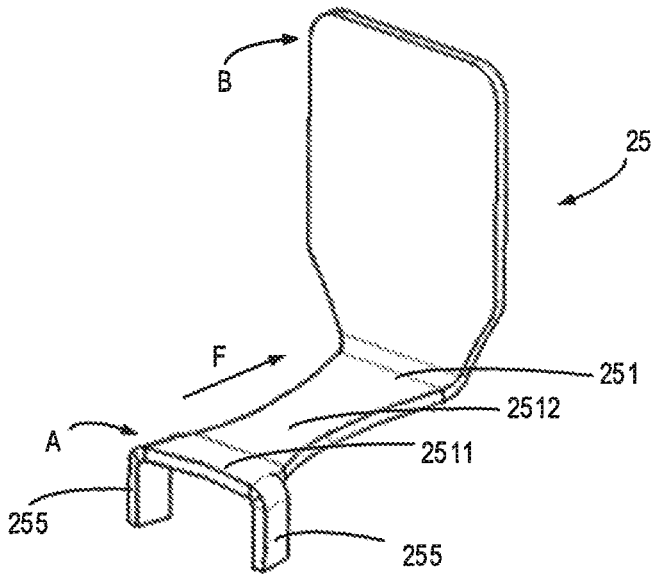
FIG. 4*b* shows a perspective view of an arc-guiding member according to another embodiment of the present disclosure.

FIGS. 4*a* and 4*b* illustrate another embodiment of the present disclosure. FIG. 4*a* shows a structure after a stationary contact body is fixedly connected with an arc-guiding member according to another embodiment of the present disclosure. FIG. 4*b* shows a structure of the arc-guiding member according to another embodiment of the present disclosure.

As shown in FIGS. 4*a* and 4*b*, the arc-guiding member 25 includes an arc guiding portion 251 and holding sheets 255 as a mounting portion. The arc guiding portion 251 has a first end A and a second end B, and a direction from the first end A to the second end B is defined as a direction F. The direction F is actually a main movement direction of the arc on the arc-guiding member 25 toward the arc extinguishing plates 41. The main movement direction of the arc refers to an overall arc movement direction, other than other local movement directions which are caused due to impact of an electromagnetic force or other factors and are different from the direction F. The arc guiding portion 251 has an arc-guiding section 2511 formed at the first end A. The arc-guiding section 2511 directly faces the stationary contact point 23 and is as close as possible to the stationary contact point 23 so that the arc may directly leave the stationary contact point 23 in the main movement direction F of the arc through the arc-guiding section 2511 and enter the arc guiding portion 251. More specifically, the arc-guiding section 2511 may be close to or in contact with the stationary contact point 23.

The difference from the previous embodiment is that, as shown in FIG. 4*b*, the arc-guiding section 2511 is a naturally-extending section of the arc-guiding member 25 instead of a protrusion shape, and at the same time, the arc-guiding member 25 is snap-fit and fixed on the stationary contact body 21 by bending the holding sheets 255. According to another embodiment, the arc-guiding member has a larger arc-guiding section along the main movement direction of the arc, which facilitates movement of the arc away from the stationary contact point. Said another embodiment also simplifies the construction of the arc-guiding member and correspondingly simplifies manufacturing and installation, thereby reducing the production costs of the switch contacts and the arc-guiding member.

Other parts of another embodiment and their corresponding technical effects are the same as in the previous embodiment, and will not be described in detail any more.

Figure 5A:
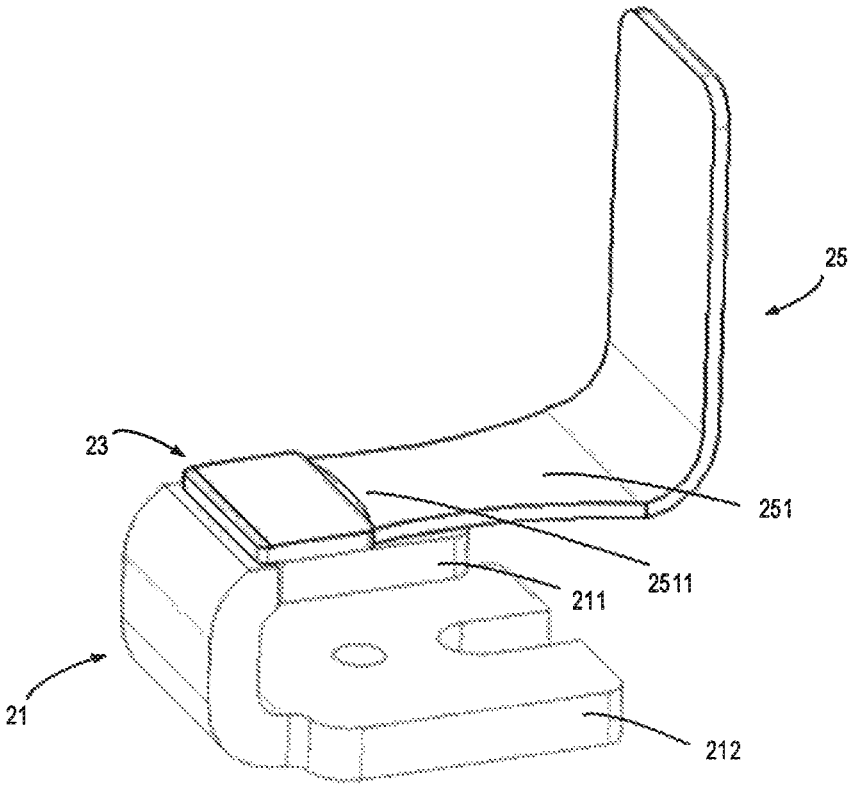
FIG. 5*a* shows a perspective view after a stationary contact body is fixedly connected with an arc-guiding member according to a further embodiment of the present disclosure.
Figure 5B:
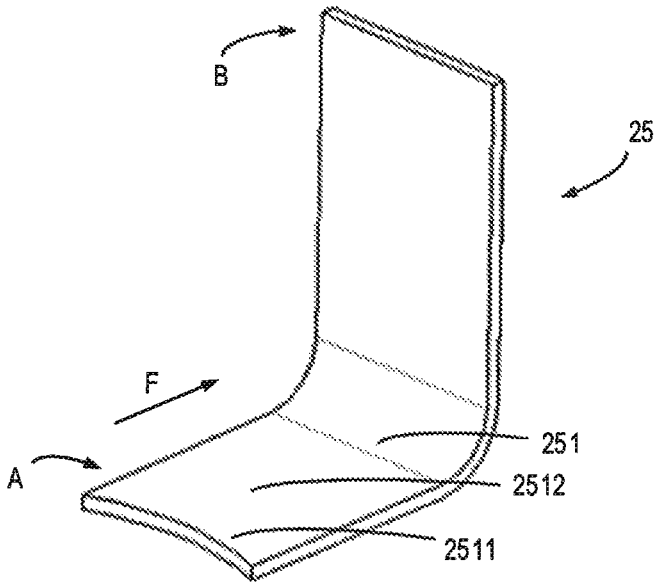
FIG. 5*b* shows a perspective view of an arc-guiding member according to a further embodiment of the present disclosure.

FIGS. 5*a* and 5*b* depict a further embodiment of the present disclosure. FIG. 5*a* shows a structure after a stationary contact body is fixedly connected with an arc-guiding member according to a further embodiment of the present disclosure. FIG. 5*b* shows a structure of the arc-guiding member according to the further embodiment of the present disclosure.

As shown in FIGS. 5*a* and 5*b*, the arc-guiding member 25 only includes the arc guiding portion 251. The arc guiding portion 251 has a first end A and a second end B, and a direction from the first end A to the second end B is defined as a direction F. The direction F is actually a main movement direction of the arc on the arc-guiding member 25 toward the arc extinguishing plates 41. The main movement direction of the arc refers to an overall arc movement direction, other than other local movement directions which are caused due to impact of an electromagnetic force or other factors and are different from the direction F. The arc guiding portion 251 has an arc-guiding section 2511 formed at the first end A. The arc-guiding section 2511 directly faces the stationary contact point 23 and is as close as possible to the stationary contact point 23 so that the arc may directly leave the stationary contact point 23 in the main movement direction F of the arc through the arc-guiding section 2511 and enter the arc guiding portion 251. More specifically, the arc-guiding section 2511 may be close to or in contact with the stationary contact point 23.

The further embodiment differs from the previous embodiments in that the arc-guiding member 25 including only the arc guiding portion 251 is directly fixed to the stationary contact body 21 by welding. This further simplifies the construction of the arc-guiding member and simplifies manufacturing and installation, and reduces the cost of the switch contacts and the arc-guiding member.

Other parts of the further embodiment and their corresponding technical effects are the same as in the previous embodiment, and will not be described in detail any more.

Figure 6:
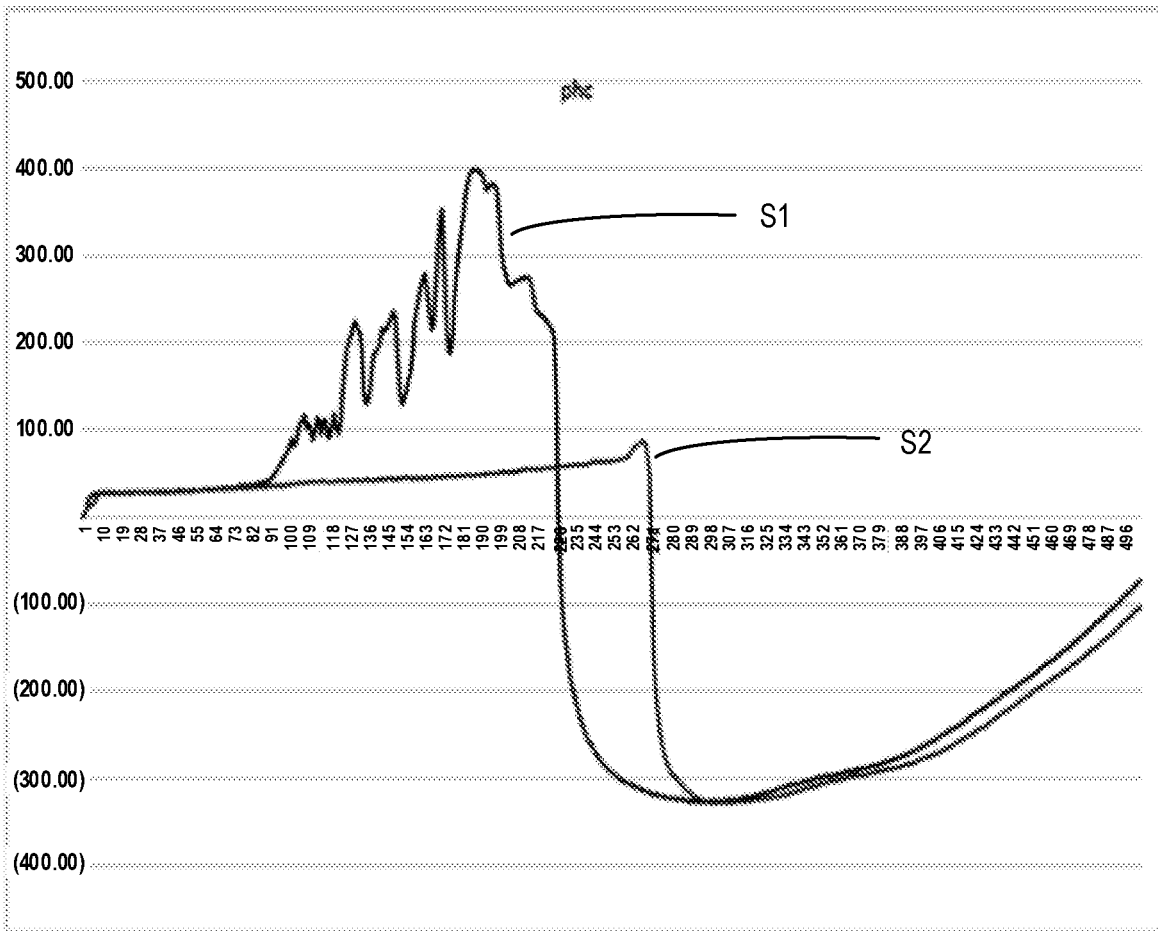
FIG. 6 shows a data graph of a comparison test of a switch contact according to the present disclosure and a conventional switch contact.

FIG. 6 shows a data graph of a comparison test of a switch contact according to embodiments of the present disclosure and a conventional switch contact. The test of the data graph shown in FIG. 6 is an electrical endurance test. Objects of the comparison test are a three-phase AC contactor S1 having the switch contact according to embodiments of the present disclosure and a three-phase AC contactor S2 having the conventional switch contact shown in FIG. 1. The test was conducted using a three-phase power supply and the voltage curves were compared at similar breaking phase angles.

FIG. 6 shows the C-phase voltage curves of S1 and S2, respectively, with a horizontal axis being a time axis (in milliseconds) and a vertical axis being the arc voltage (in volts). As is apparent from FIG. 6, the arc voltage of S1 according to the present disclosure is obviously larger than the arc voltage of the conventional contactor S2, and a higher arc voltage is more advantageous for moving and extinguishing the arc.

In addition, reference is made to Table I below. The data in Table I is taken from the test shown in FIG. 6.

TABLE I

| | S1 | S2 |
|---|---|---|
| Peak arc voltage (V) | 400 | 90 |
| Arc duration (ms) | 4.34 | 5.3 |

As can be seen from Table I, the arc voltage of S1 according to the present disclosure is much larger than the arc voltage of the conventional contactor S2, and the arc duration is also significantly shortened.

It can thus be seen that the switch contact with the arc-guiding member according to the embodiments of the present disclosure can guide the arc away from the contact point into the arc-guiding member more quickly, can avoid the deformation of the contact and reduce the length supported by the contact and thereby reduce the cost.

Through the teaching given by the above depictions and related figures, many modifications and other embodiments of the present disclosure will be apparent to those skilled in the art. Therefore, it is to be appreciated that the embodiments of the present disclosure are not limited to the disclosed specific embodiments, and modifications and other embodiments are intended to be included within the scope of the present disclosure. In addition, while the above description and related figures have described example embodiments in the context of certain example combinations of components and/or functions, it should be appreciated that different combination forms of the components and/or functions may be provided by alternative embodiments without departing from the scope of the present disclosure. In this regard, for example, other combination forms of components and/or functions that are different from those explicitly described above are also contemplated as being within the scope of the present disclosure. Although specific terms are employed herein, they are used in a generic and illustrative sense and are not intended to be limiting.

We claim:

1. A stationary contact assembly comprising:

a stationary contact body;

a stationary contact point placed on the stationary contact body; and an arc-guiding member fixed on the stationary contact body and comprising an arc guiding portion, the arc guiding portion comprising a first end and a second end opposite to each other, the first end being close to the stationary contact point, a direction from the first end to the second end defining a main movement direction of an arc, the arc guiding portion of the arc-guiding member comprising an arc-guiding section at the first end, the arc-guiding section being adapted to guide the arc away from the stationary contact point into the arc guiding portion, and the stationary contact point being close to or in contact with the arc-guiding section in the main movement direction of the arc, wherein the arc-guiding member further comprises a mounting portion adapted to fix the arc-guiding member onto the stationary contact body, wherein the mounting portion is connected to the arc guiding portion, an opening is formed at a connection of the mounting portion and the arc guiding portion, and the opening is adapted to allow the stationary contact body to pass therethrough so that the stationary contact point is close to the arc-guiding section at the opening, and wherein the mounting portion is formed with a support platform on a side adjacent to the opening, and the support platform supports the stationary contact body at the opening.

2. The stationary contact assembly of claim 1, wherein the arc-guiding member is fixed onto the stationary contact body by welding.

3. The stationary contact assembly of claim 1, wherein the arc-guiding member is formed with holding sheets at the first end of the arc guiding poriton, and the arc-guiding member is snap-fitted and fixed onto the stationary contact body by bending the holding sheets.

4. The stationary contact assembly of claim 1, wherein the mounting portion is made of a magnetically conductive material at least at a section forming the support platform.

5. The stationary contact assembly of claim 1, wherein a side of the stationary contact body passing through the opening is located below the arc-guiding section so as to be clamped between the arc-guiding section and the support platform.

6. The stationary contact assembly of claim 1, wherein the mounting portion is formed with a mounting hole for fixing the arc-guiding member onto the stationary contact body via a screw.

7. The stationary contact assembly of claim 6, wherein the mounting hole of the mounting portion is a circular hole or U-shaped hole.

8. The stationary contact assembly of claim 1, wherein the arc-guiding section is a protrusion extending from the arc guiding portion, and the protrusion extends in a direction opposite to the main movement direction of the arc.

9. The stationary contact assembly of claim 8, wherein the protrusion is tongue-shaped.

10. The stationary contact assembly of claim 1, wherein a region of the arc guiding portion following the arc-guiding section along the main movement direction of the arc is of a larger thickness than other regions of the arc guiding portion.

11. The stationary contact assembly of claim 1, wherein the arc guiding portion itself is integrally formed.

12. The stationary contact assembly of claim 1, wherein the arc-guiding member itself is integrally formed.

13. The stationary contact assembly of claim 1, wherein the arc-guiding member is formed in a zigzag shape.

14. The stationary contact assembly of claim 1, wherein the stationary contact body is of a U shape with a long side and a short side, the stationary contact point is placed on the short side of the U shape, and the short side of the stationary contact body passes through the opening of the arc-guiding member.

15. A switch contact comprising a stationary contact, a movable contact, and an arc extinguishing element, the stationary contact comprising the stationary contact assembly according to claim 1.

* * * * *